US005931742A

United States Patent [19]

Nishimura et al.

[11] Patent Number: 5,931,742

[45] Date of Patent: Aug. 3, 1999

[54] GOLF CLUB HEAD

[75] Inventors: Toshinori Nishimura; Masahiko Miyamoto, both of Hiratsuka, Japan

[73] Assignee: The Yokohama Rubber Co., Ltd., Tokyo, Japan

[21] Appl. No.: 08/940,018

[22] Filed: Sep. 29, 1997

[30] Foreign Application Priority Data

| | | | |
|---|---|---|---|
| Oct. 30, 1996 | [JP] | Japan | 8-288311 |
| Oct. 30, 1996 | [JP] | Japan | 8-288313 |
| Oct. 30, 1996 | [JP] | Japan | 8-288317 |

[51] Int. Cl.[6] ..... A63B 53/02

[52] U.S. Cl. ..... 473/305; 473/311; 473/345

[58] Field of Search ..... 473/305, 308, 473/309, 310, 311, 345, 349

[56] References Cited

U.S. PATENT DOCUMENTS

| | | | |
|---|---|---|---|
| 4,417,731 | 11/1983 | Yamada | 473/305 |
| 4,697,813 | 10/1987 | Inoue | 473/345 |
| 5,193,811 | 3/1993 | Okumoto et al. | 473/349 |
| 5,632,695 | 5/1997 | Hlinka et al. | 473/341 |
| 5,685,784 | 11/1997 | Butler | 473/340 |

*Primary Examiner*—Kien T. Nguyen

*Attorney, Agent, or Firm*—Finnegan, Henderson, Farabow, Garrett & Dunner, L.L.P.

[57] ABSTRACT

A metallic hollow golf club head comprising a head main body having a sole and a crown, a shaft insertion hole provided in the crown, and a hosel for supporting an end of a shaft secured to the inner surface of the sole, the top end of the hosel being kept untouched to the shaft insertion hole.

16 Claims, 5 Drawing Sheets

GOLF CLUB HEAD

BACKGROUND OF THE INVENTION

The present invention relates to a metallic hollow golf club head and more particularly to a golf club head having a shaft with excellent resistance to bending and capable of obtaining secure direction and a high trajectory.

In a conventional hollow metallic golf club head as shown in FIG. 15, a head main body 1 of the club head comprises at least a sole 5 and a crown 3 which are joined together to form one unit, a hosel 2 being molded to the crown 3. The hosel 2 protrudes out from the crown 3 and the end of a shaft 4 is inserted into the hosel 2 and secured.

However, since a golf club head in which the hosel 2 has been secured to the crown 3 of the head main body 1 to form a single unit as above forms a thorough solid structure, there is almost no shift or variation in the position of the head main body 1 with respect to the hosel 2 when the club is swung or impacts with a ball.

Therefore, the direction of the ball at impact is not related to shift or variation in the position of head main body 1, but is greatly influenced by shaft properties such as flexure and torsion, and it has not been possible to obtain stable direction or trajectory of a ball.

Furthermore, in a conventional golf club, concentration of stress at the end of the hosel 2 upon impact with the ball has caused bending in the shaft 4.

SUMMARY OF THE INVENTION

It is the object of the present invention to provide a metallic hollow golf club head capable of obtaining stable ball direction and trajectory without the influence of shaft properties. The present invention further aims to provide a metallic hollow golf club head having a shaft with excellent resistance to bending.

In order to achieve the above objectives, the golf club head of the present invention comprises a metallic hollow golf club head comprising a head main body having a sole and a crown, a shaft insertion hole provided in the crown, and a hosel for supporting the end of a shaft solidly secured to the inner surface of the sole, the top end of the hosel being kept untouched to the shaft insertion hole.

By securing the hosel to the inner surface of the sole with the top of the hosel untouched to the shaft insertion hole provided on the crown, when the golf club is swung or impacts with a ball, the position of the head itself with respect to the hosel can shift or vary, enabling stable ball direction and trajectory to be obtained without influence from properties of the shaft.

Furthermore, since the shaft insertion hole provided in the crown does not directly contact the shaft, it is possible to prevent the shaft from being bent when the golf club is swung or impacts with a ball.

For a more complete understanding of the present invention and the advantages thereof, reference is now made to the following description taken in conjunction with the accompanying drawings.

DETAILED DESCRIPTION OF THE PREFERRED EMBODIMENTS

Figure 1:
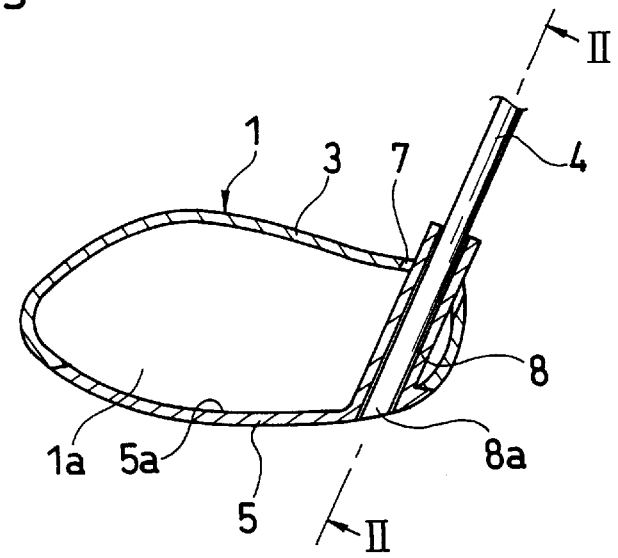
FIG. 1 is a diagram depicting a vertical cross-sectional frontal view of a wood-type golf club head according to a first embodiment of the present invention.
Figure 2:
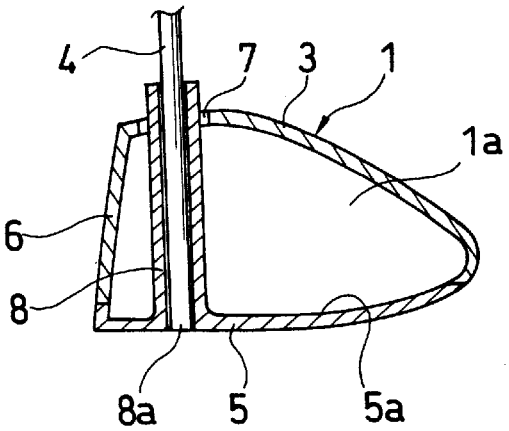
FIG. 2 is a diagram depicting a cross-sectional view taken along the line II—II of FIG. 1.

FIG. 1 and FIG. 2 show a wood-type golf club head in a first embodiment of the present invention. In FIGS. 1 and 2, the head main body 1 has an outer mold comprising a crown 3 and a face 6, and a sole 5 which is attached to the bottom of the outer mold.

A shaft insertion hole 7 for inserting a shaft is provided in crown 3, while a hosel 8 is solidly secured to the inner surface 5*a* of sole 5, the top end of this hosel 8 passing through shaft insertion hole 7 in crown 3 without touching it.

Hosel 8 comprises a hollow tube, into which the end of shaft 4 is inserted and secured. The bottom 8*a* of the hollow tube-shaped hosel 8 may be sealed or open. Shaft insertion hole 7 is wider than the diameter of hosel 8 and is constructed so that hosel 8 does not directly contact the inner edge of the shaft insertion hole 7.

The outer mold comprising crown 3 and face 6 is hollow and is molded in one piece using a metal with low specific gravity such as, for instance, titanium or aluminium, or an alloy thereof. By contrast, sole 5 and hosel 8 are molded using a metal having a higher specific gravity than crown 3 and face 6 such as, for instance, copper, steel, brass, tungsten, or an alloy thereof. The outer mold comprising crown 3 and face 6, and sole 5 and hosel 8 can be molded using the same type of metal.

Figure 13:
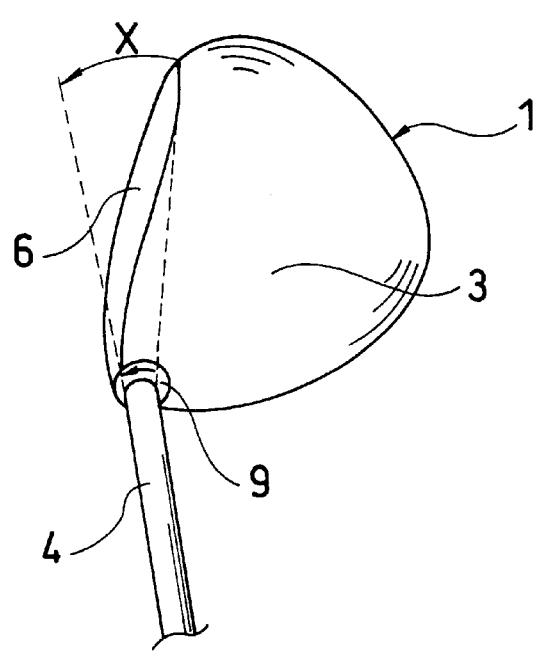
FIG. 13 is a diagram depicting a top view of the shift or variation in the position of a head main body when the golf club is swung or impacts with a ball.
Figure 14:
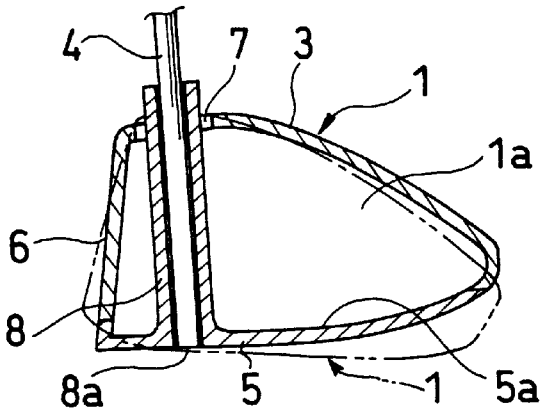
FIG. 14 is a diagram depicting a vertical cross-sectional view of the shift or variation in the position of a head main body when the golf club is swung or impacts with a ball.
Figure 15:
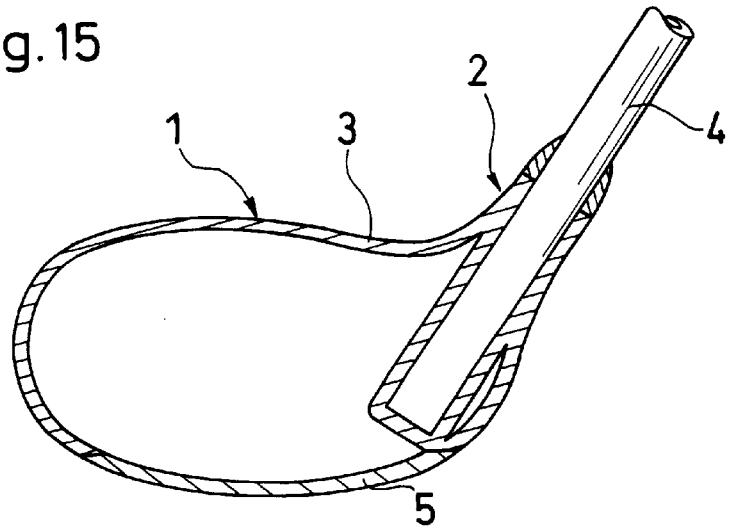
FIG. 15 is a diagram depicting a vertical cross-sectional front view of a conventional wood-type golf club head.

In the golf club head in the above configuration, hosel 8 is secured to the inner surface 5*a* of sole 5 and does not make contact with crown 3. The head main body 1 is thus able to shift or vary its position with respect to hosel 8 more easily than in the case of a conventional golf club head in which the hosel is solidly connected to the crown of the head main body. Therefore, when the golf club head is swung or impacts with a ball, head main body 1 can alter its position with respect to hosel 8 as indicated by the symbol X in FIG. 13, consequently obtaining stable ball direction without the influence of shaft properties such as flexure, torsion and elasticity. Furthermore, since the dynamic loft angle of the head main body 1 is increased as shown by the broken line in FIG. 14, higher trajectory can be obtained.

Furthermore, since the shaft insertion hole 7 provided on crown 3 does not directly contact with the shaft 4 and the hosel 8, shaft bending when the golf club head is swung or impacts with a ball can be prevented.

Moreover, a metal with a low specific gravity is used to form the outer mold comprising crown 3 and face 6, while a metal with a higher specific gravity than this outer mold is used to form sole 5 and hosel 8. The center of mass of the head main body 1 is thereby lowered, facilitating a ball to be lifted. Furthermore, forming sole 5 and hosel 8 from the same metal in order to make it possible to weld them together improves their workability in assembly.

Figure 3:
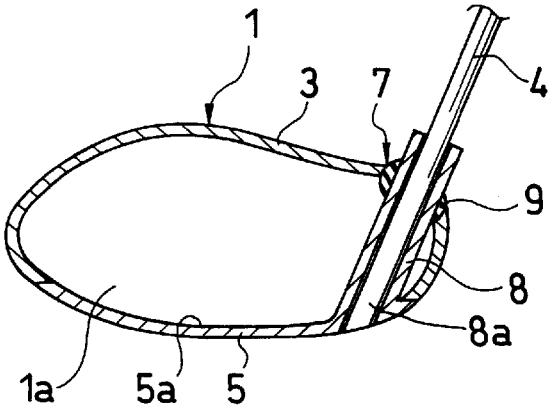
FIG. 3 is a diagram depicting a vertical cross-sectional frontal view of a wood-type golf club head according to a second embodiment of the present invention.

FIG. 3 shows a wood-type golf club head in a second embodiment of the present invention. In this embodiment, the gap between the inner edge of shaft insertion hole 7 and hosel 8 in the embodiment described above is filled with an elastic material 9 such as rubber or flexible resin in order to elastically support hosel 8 and shaft 4.

This elastic material 9 not only elastically supports hosel 8 and shaft 4, but it also functions as a seal for preventing dirt and water from entering the hollow portion 1*a* of head main body 1 through shaft insertion hole 7. Moreover, elastic material 9 can improve the feel of the swing by preventing air-cutting noise when the club is swung and refining ball-impact sound.

Figure 4:
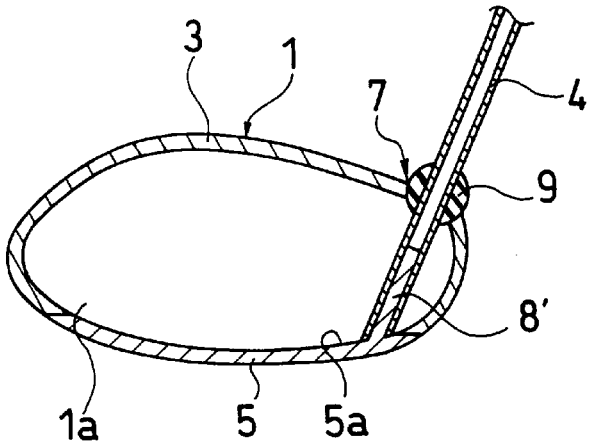
FIG. 4 is a diagram depicting a vertical cross-sectional frontal view of a wood-type golf club head according to a third embodiment of the present invention.

FIG. 4 shows a wood-type golf club head in a third embodiment of the present invention. In the third embodiment, a hosel 8' comprising a faithful rod is secured in one piece to the inner surface 5*a* of sole 5, and the hollow end of shaft 4 is engaged with this rod-shaped hosel 8'.

In a golf club head in this configuration, when the golf club head is swung or impacts with a ball, the position of head main body 1 can shift or vary with respect to hosel 8' as in the embodiments explained above, thereby obtaining stable ball direction and trajectory without being influenced by properties of shaft 4.

Figure 5:
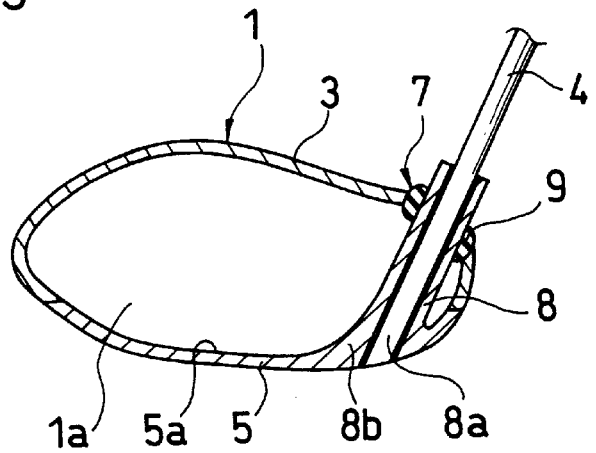
FIG. 5 is a diagram depicting a vertical cross-sectional frontal view of a wood-type golf club head according to a fourth embodiment of the present invention.

FIG. 5 shows a wood-type golf club head in a fourth embodiment of the present invention. In the fourth embodiment, the bottom end portion 8*b* of a hollow tube-shaped hosel 8 which is secured to the inner surface 5*a* of sole 5 is thicker than the top end of the hosel 8.

Thickening the portion 8*b* of hosel 8 which is secured to sole 5 in this manner serves to reinforce the secured portion 8*b* and improves the impact durability of hosel 8.

Figure 6:
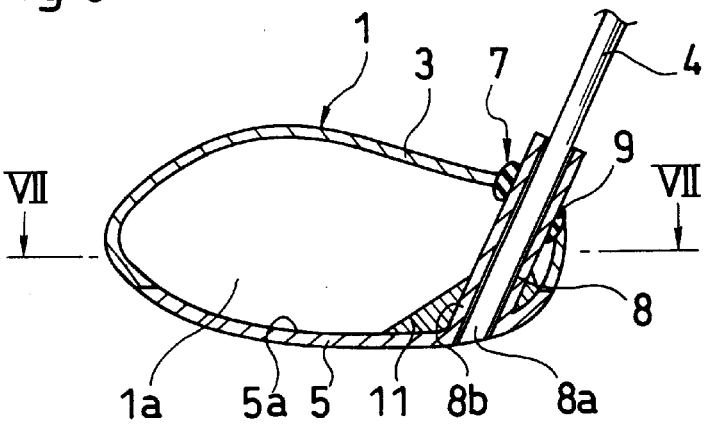
FIG. 6 is a diagram depicting a vertical cross-sectional frontal view of a wood-type golf club head according to a fifth embodiment of the present invention.
Figure 7:
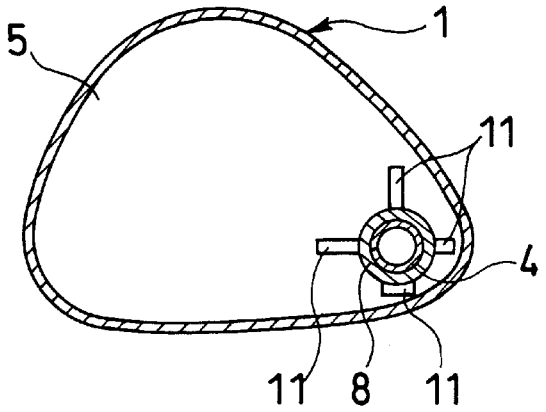
FIG. 7 is a diagram depicting a cross-sectional view taken along the line VII—VII of FIG. 6.

FIG. 6 and FIG. 7 show a wood-type golf club head in a fifth embodiment of the present invention. In the fifth embodiment, a plurality of ribs 11 are solidly provided to the bottom end portion 8*b* of a hollow tube-shaped hosel 8 which is secured to the inner surface 5*a* of sole 5.

Providing reinforcing ribs 11 to the secured portion 8*b* of hosel 8 in this manner enables the impact durability of hosel 8 to be improved.

Figure 8:
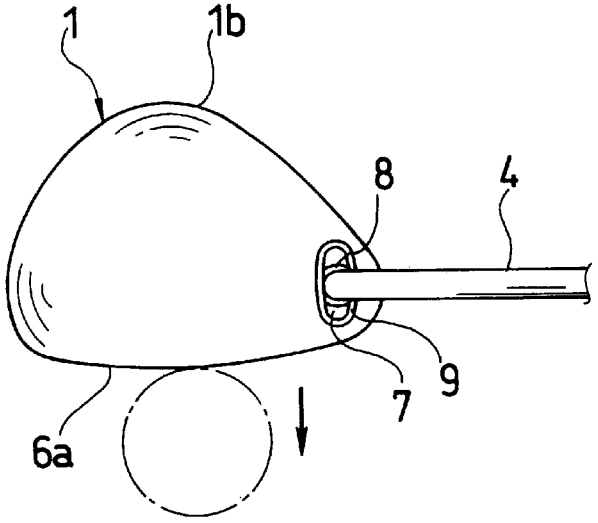
FIG. 8 is a diagram depicting a vertical cross-sectional frontal view of a wood-type golf club head according to a sixth embodiment of the present invention.

FIG. 8 shows a wood-type golf club head in a sixth embodiment of the present invention. In the sixth embodiment, shaft insertion hole 7 is wider than the diameter of hosel 8 and comprises a long hole extending from the face surface 6*a* to the rear 1*b* of head main body 1.

The provision of a long shaft insertion hole 7 extending from face surface 6*a* to the rear 1*b* of head main body 1 as described above increases the dynamic loft angle of head main body 1 when striking the ball in order to facilitate ball-lift, and restricts the amount of toe-down when swinging.

Toe-down is the amount of movement of the center (sweet spot) of the face side of the club head with respect to the center of a golf ball when, after aligning the center of the face side of the club head with the center of the golf ball mounted on a tee, the club shaft has flexed due to centrifugal force and gravity acting on the club head as the golf club was swung toward the golf ball by the player. The amount of toe-down is generally 5 mm~30 mm.

When toe-down increases, the center of the golf ball is struck by the toe of the club head, destabilizing the direction in which the golf ball is driven. Furthermore, when the position of the club head at which the ball is struck has been displaced due to toe-down effect, driving distance is reduced since maximum repulsion properties of the club head cannot be obtained.

Restricting toe-down by providing a long shaft insertion hole 7 makes it possible to stabilize ball striking, thereby drawing out the maximum repulsion properties of the club head and increasing driving distance.

FIG. 9 to FIG. 12 respectively show wood-type golf club heads in seventh to tenth embodiments of the present invention. These embodiments prevent extraneous substances from entering the hollow portion 1*a* of head main body 1 through shaft insertion hole 7.

Figure 9:
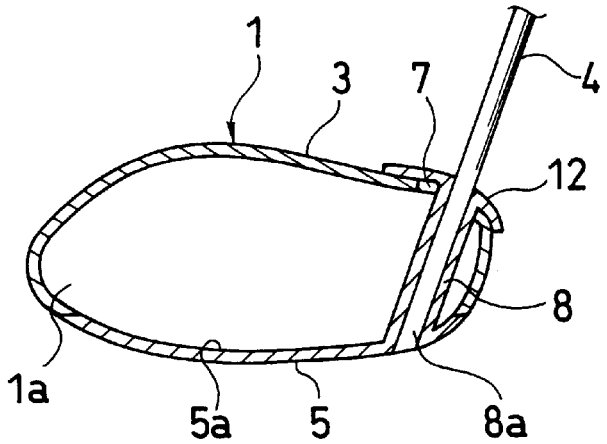
FIG. 9 is a diagram depicting a vertical cross-sectional frontal view of a wood-type golf club head according to a seventh embodiment of the present invention.

In the seventh embodiment shown in FIG. 9, a flange 12 is provided on the top end of a hollow tube-shaped hosel 8 in order to seal the gap between shaft insertion hole 7 and the hosel 8.

Figure 10:
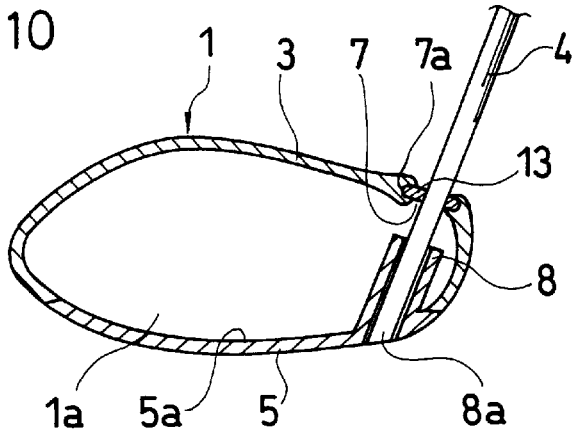
FIG. 10 is a diagram depicting a vertical cross-sectional frontal view of a wood-type golf club head according to an eighth embodiment of the present invention.

In the eight embodiment shown in FIG. 10, sealing material 13 such as an O ring or rubber or plastic is inserted between shaft insertion hole 7 and shaft 4. Sealing material 13 may preferably be held in place by forming an indented portion 7*a* on the inner edge of shaft insertion hole 7. This indented portion 7*a* enables sealing material 13 to be easily inserted and removed.

Figure 11:
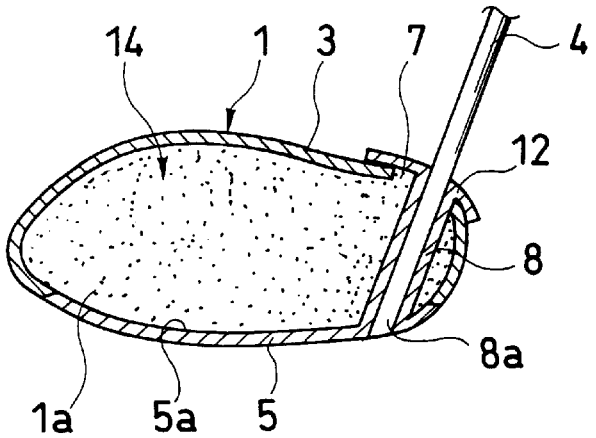
FIG. 11 is a diagram depicting a vertical cross-sectional frontal view of a wood-type golf club head according to a ninth embodiment of the present invention.

In the ninth embodiment shown in FIG. 11, the hollow portion 1*a* inside the main body 1 of the golf club head is filled with filling material 14 such as water resistant foam resin in order to seal the shaft insertion hole 7.

Figure 12:
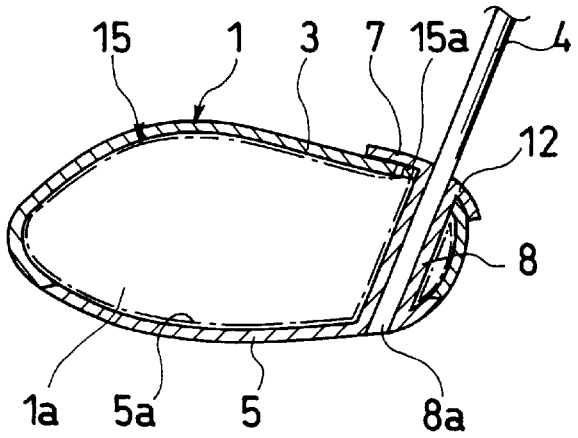
FIG. 12 is a diagram depicting a vertical cross-sectional frontal view of a wood-type golf club head according to a tenth embodiment of the present invention.

In the tenth embodiment shown in FIG. 12, the hollow portion la of the head main body 1 contains an air bag 15 which has an air injection entrance 15*a* provided near shaft insertion hole 7. Air is supplied and discharged through air injection entrance 15*a*, and shaft insertion hole 7 is sealed by filling the air bag 15 with air.

The embodiments shown in FIGS. 9 to 12 are capable of preventing extraneous substances such as dirt or water from entering the hollow portion 1*a* of head main body 1. In addition, these embodiments prevent air-cutting noise when the golf club head is swung and improve the feel of the swing by refining the sound when impacting the ball. In particular, when sealing material 13 is provided on the inner edge of shaft insertion hole 7 as shown in FIG. 10, the shaft 4 is prevented from touching the inner edge of shaft insertion hole 7 and from damage resulting therefrom.

Each of the above embodiments described a wood-type golf club head, but the present invention is also applicable to an iron-type golf club head.

According to the present invention explained above, by securing the hosel to the inner surface of the sole and placing the top end of the hosel through a shaft insertion hole provided in the crown, the position of the head main body with respect to the hosel can shift or vary when the golf club head is swung or impacts with a ball, thereby making it possible to obtain stable ball direction and a high trajectory without influence of shaft properties.

Furthermore, since the shaft insertion hole provided in the crown does not directly contact the shaft, bending in the shaft when the golf club head is swung or impacts with a ball can be prevented. Moreover, when a cushion for elastically supporting the shaft is provided to the inner edge of the shaft insertion hole, shaft bending can be even more effectively prevented.

Furthermore, when the crown comprises a metal having a low specific gravity while the sole and hosel comprise metals having a high specific gravity, the center of mass of the head main body can be lowered, facilitating ball lift. Moreover, when the sole and the hosel comprise the same type of metal, they can be more easily welded together, improving workability in assembly between the sole and the hosel.

Furthermore, the dynamic loft angle of the golf club head when striking a ball can be increased and ball lift further facilitated by providing a long shaft insertion hole 7 extending from the face side to rear side; toe-down during swing is consequently restricted, further stabilizing ball impact.

Furthermore, gaps between the shaft insertion hole and the shaft or the hosel can be sealed by a variety of methods, making it possible to prevent extraneous substances such as dirt and water from entering the hollow portion of the main body of the club head.

While there have been described what are at present considered to be preferred embodiments of the invention, it will be understood that various modifications may be made thereto, and it is intended that the appended claims cover all such modifications as fall within the true spirit and scope of the invention.

What is claimed is:

1. A metallic hollow golf club head comprising a hollow head main body of metal having a sole and a crown, a shaft insertion hole in said crown, and a hosel comprising a hollow tube for receiving a lower end of a shaft and having a bottom end secured to an inner surface of said sole, a top end of said hosel being out of direct contact said shaft insertion hole to permit relative movement between the top end of said hosel and the crown of the head main body when the club head is swung or impacts a ball.

2. The golf club head of claim 1 wherein the hollow head main body is a wood-type golf club head.

3. The golf club head of claim 1, wherein the top end of said hosel extends through the shaft insertion hole and protrudes beyond an exterior surface of said crown.

4. The golf club head of claim 3, further comprising elastic material between said shaft insertion hole and said hosel.

5. The golf club head of claim 3, further comprising a flange on the top end of said hosel for sealing a gap between said shaft insertion hole and said hosel.

6. The golf club head of claim 3, further comprising sealing material in a gap between said hosel and said shaft insertion hole.

7. The golf club head of claim 1, wherein the top end of said hosel is located inside said crown.

8. The golf club head of claim 1, wherein the bottom end of said hosel that is secured to the inner surface of said sole is thicker than the top end of said hosel.

9. The golf club head of claim 1, further comprising ribs on the bottom end of said hosel that are secured to said sole.

10. The golf club head of claim 1, wherein said crown comprises a metal having a low specific gravity, and said sole and said hosel comprise a metal having a higher specific gravity than said metal of said crown.

11. The golf club head of claim 10, wherein said metal having a low specific gravity is selected from the group consisting of titanium and aluminium.

12. The golf club head of claim 10, wherein said metal having a higher specific gravity is selected from the group consisting of copper, steel, brass and tungsten.

13. The golf club head of claim 1, wherein said sole and said hosel are of the same metal.

14. The golf club head of claim 1, said shaft insertion hole comprises an elongated long hole extending from a face side of said head main body to a rear side thereof.

15. The golf club head of claim 1, further comprising filling material filled inside a hollow portion of said head main body for sealing said shaft insertion hole.

16. The golf club head of claim 1, further comprising an air bag contained within a hollow portion of said head main body for sealing said shaft insertion hole.

* * * * *